United States Patent [19]

Amos

[11] 4,099,768

[45] Jul. 11, 1978

[54] CONVERTIBLE SEAT-BED UNIT

[76] Inventor: James Amos, Box 2625, Muncie, Ind. 47302

[21] Appl. No.: 710,277

[22] Filed: Jul. 30, 1976

[51] Int. Cl.[2] ..... A47C 13/00

[52] U.S. Cl. ..... 297/63; 5/37 R

[58] Field of Search ..... 297/63, 64, 65, 359; 248/429; 5/37 R

[56] References Cited

U.S. PATENT DOCUMENTS

| | | | |
|---|---|---|---|
| 1,224,982 | 5/1917 | Washeim | 5/37 R |
| 1,608,064 | 11/1926 | Henry | 297/63 X |
| 2,094,410 | 9/1937 | Redding | 5/37 R |
| 3,743,350 | 7/1973 | Allen | 297/64 X |
| 3,784,252 | 1/1974 | Peterson | 297/359 X |
| 3,887,229 | 6/1975 | Plume | 297/65 |

FOREIGN PATENT DOCUMENTS

| | | | |
|---|---|---|---|
| 30,759 | 12/1930 | Australia | 297/64 |

*Primary Examiner*—James T. McCall
*Attorney, Agent, or Firm*—Glenn B. Morse

[57] ABSTRACT

Seat and back sections of the unit are pivotally interconnected so that they may be placed in selected angular relationships, including coplanar. Links interconnect this sub-assembly to a base frame so that the subassembly can be supported in either of two positions which are spaced horizontally. This arrangement permits a pair of units to be installed on opposite sides of a removable table to function as seats, and then be shifted together, after removal of the table, to eliminate the leg space and form a continuous bed surface when the seat and back sections are in coplanar position. A locking system secures the selected position determined by the links, and also the angular relationship of the seat and back sections.

3 Claims, 16 Drawing Figures

CONVERTIBLE SEAT-BED UNIT

BACKGROUND OF THE INVENTION

In living areas where space is at a premium, it is common practice to conserve space by combining a dinette area with a bed. This is done by removing the usual table panel, and then placing the seat and back sections of a bench-type unit in coplanar relationship, accompanied by a lateral shifting of the two opposite bench units toward each other to eliminate the leg space and present a continuous bed surface. The lateral shifting has usually been provided by tracks that are either separately installed on the surrounding structure, or mounted on a frame so that the entire assembly is integral and subject only to simple mounting connections on the wall and floor. A problem is always present in any such track system. The tracks on the opposite sides of the seating units must remain very close to parallelism, requiring precision in manufacture, and also freedom from installation distortion. Provision must also be made for identical movement along the tracks on the opposite sides of the seat unit, or a jamming action is sure to take place. Cable systems or rack-and-gear arrangements are normally used to provide this correspondence in movement, but this sort of mechanism usually results in rather expensive structures. The objective of the present invention is to provide the lateral shifting feature and the angular adjustability of the seat and back sections with a minimum of cost and maintainence, while using standard techniques of fabrication.

SUMMARY OF THE INVENTION

The seat and back sections of a seating unit are provided with overlapping side plates on each side. These plates are pivotally interconnected to establish the angular adjustability between the seat and back sections. The sub-assembly of the seat and back sections is itself connected to a base frame by links on both sides of the unit, the opposite ends of the links being pivotally secured to the frame. The seat and back sections, as a sub-assembly, are adapted to rest on the base frame in either of two positions, with the shifting from one position to the other being accompanied by a rotation of the links about their axis of connection to the base frame so that the seating unit is lifted slightly upward as it is alternatively deposited in either of the two positions. The links in the opposite side of the base frame are interconnected by a shaft to assure identity of motion. A locking system is adapted to secure the seat-back sub-assembly in either of the two selected positions, with the locking arrangement also having the function of securing the angular relationship between the seat and back sections. Preferably, the pivotal connection between the seat and back sections is the same as the connection of the links to the seat-back sub-assembly.

DESCRIPTION OF THE DRAWINGS

FIG. 5 is on a slightly enlarged scale over that of FIG. 4.

In FIG. 11, the webbing has been removed for clarity.

In FIG. 13, the webbing has been removed from the seat and back sections for clarity.

DESCRIPTION OF THE PREFERRED EMBODIMENT

Figure 1:
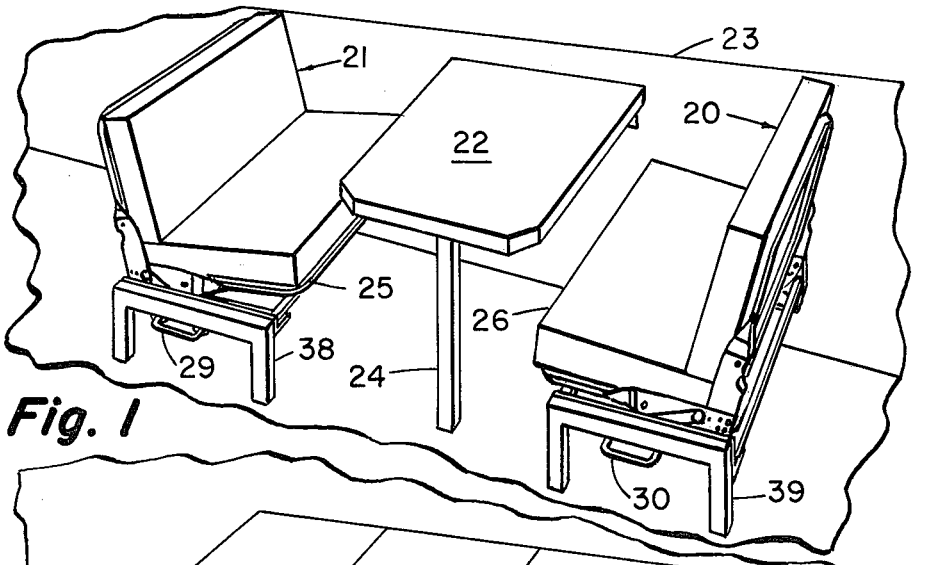
FIG. 1 is a perspective view showing a dinette area formed by a pair of seat-bed units installed on opposite sides of a removable table.
Figure 2:
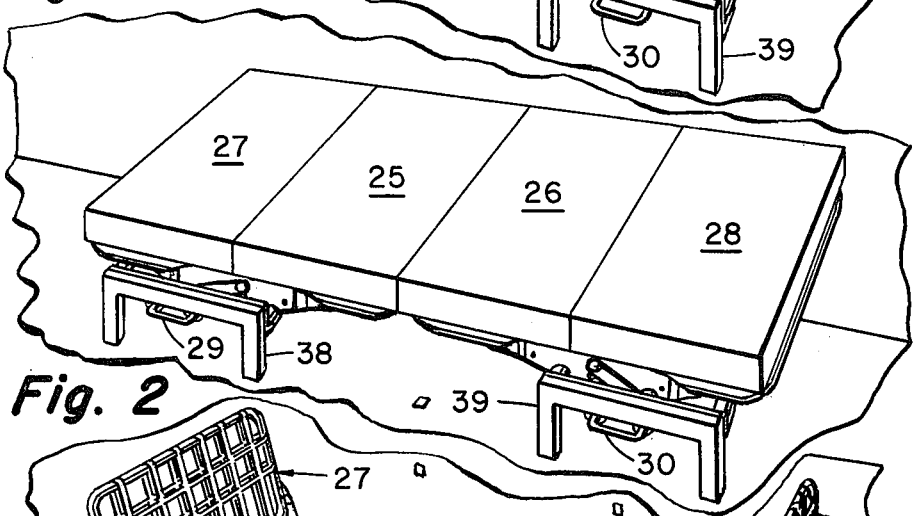
FIG. 2 is a perspective view of the two seat-bed sections shown on FIG. 1, placed in coplanar adjacent relationship after removal of the table.
Figure 3:
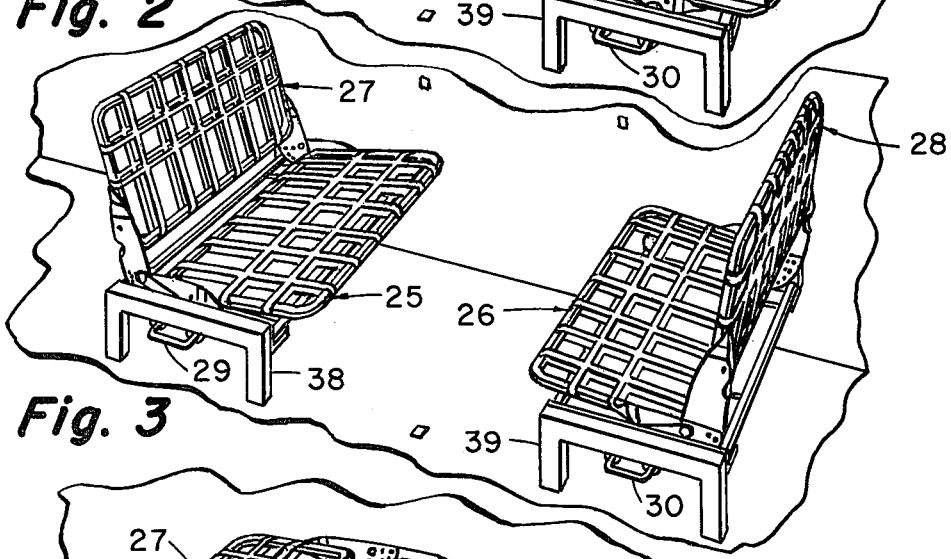
FIG. 3 is a perspective view of the understructure of the seat-back sections, with the upholstery portions removed.
Figure 4:
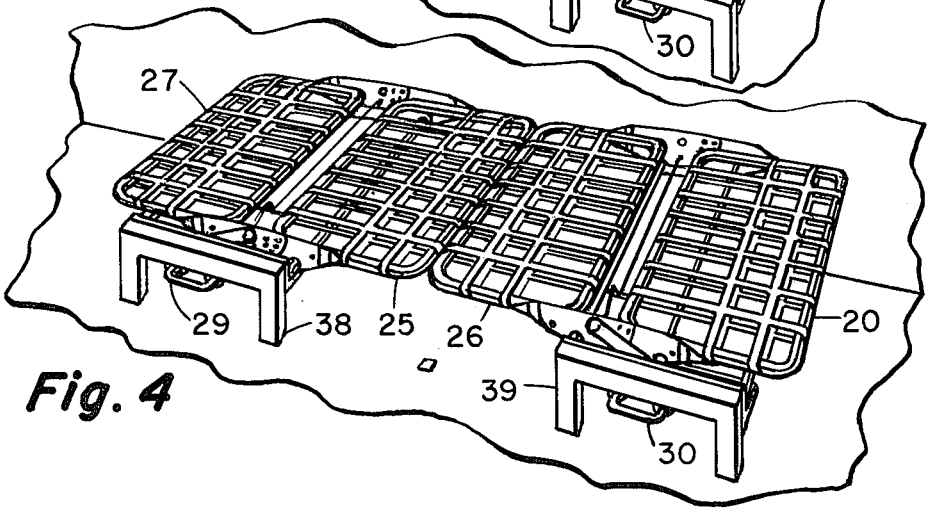
FIG. 4 is a perspective view showing the FIG. 3 components in the FIG. 2 position.

Referring to FIGS. 1 and 2, the seat-bed units generally indicated at 20 and 21 are installed on opposite sides of a removable table 22 connected at one edge to the wall surface 23, and supported at its outer end by the leg 24. The structure of the units 20 and 21 is identical. The group shown in FIG. 1 may be converted to a bed, as shown in FIG. 2, by removal of the table 22 and the leg 24, followed by the placement of the units 20 and 21 into a position in which the seat sections 25 and 26 and the back sections 27 and 28 are in horizontal coplanar relationship, and are shifted laterally to form a continuous bed surface. The units 20 and 21 are preferably constructed so that they can be installed in either right or left-hand relationship. The unit 20 is capable of assuming the position of the unit 21, without rotation of the assembly on a vertical axis. This arrangement permits the locking mechanisms (including the handles 29 and 30) to have the same relationship with the base frame.

The preferred structure of the base frame includes the parallel steel tubes 31 and 32 respectively connected to the end angles 33 and 34 by welding or brazing. The unit is mounted in the position shown in FIGS. 1 and 2 by the installation of screws or bolts traversing openings as indicated at 35–37 in the several views of the drawings, and engaging either the wall structure 23 or the horizontal member of the leg units 38 or 39. The openings 35–37 are preferably formed in outwardly dimpled sections of the end angles to provide positive points of bearing engagement without interfering with the portions of the locking mechanism and shafts that traverse the end sections of the base frame.

Figure 5:
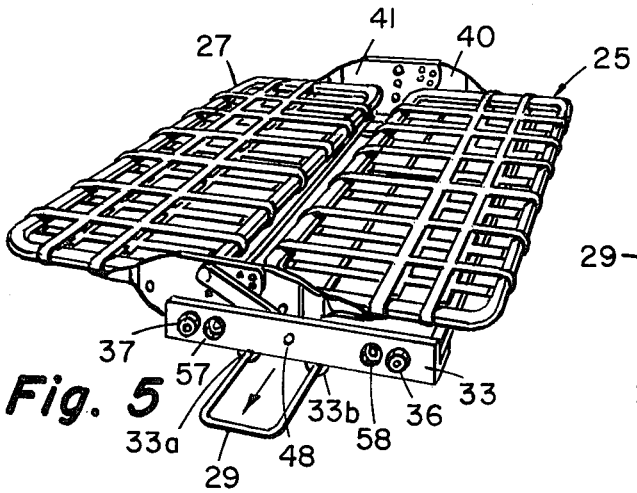
FIG. 5 is a view of one of the seat-bed sections in the horizontal coplanar position, with the locking arrangement disengaged.
Figure 9:
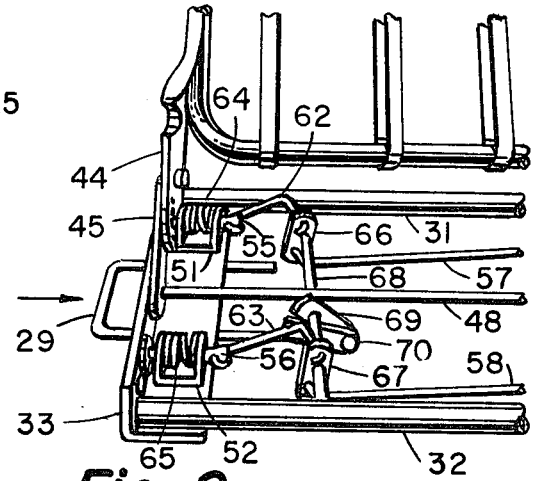
FIG. 9 is a view similar to FIG. 8, with the locking system engaged.
Figure 10:
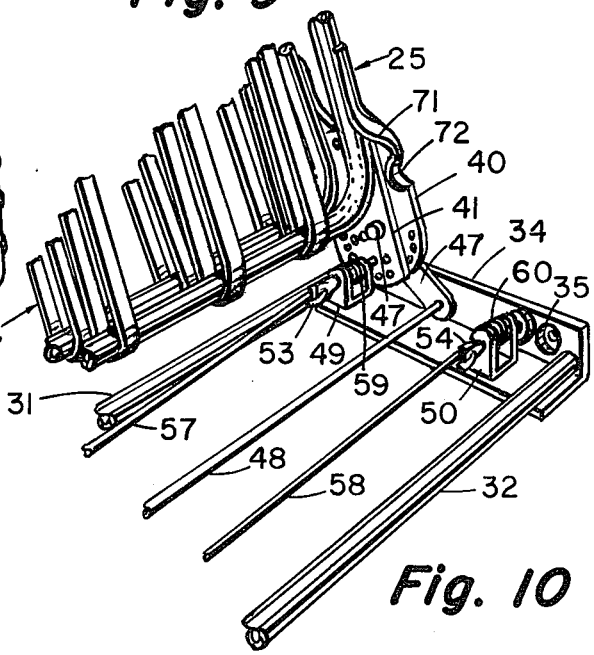
FIG. 10 is a fragmentary perspective view at one side of the assembly, showing a possible position of angular adjustment of the seat and back sections into a position of parallelism.
Figure 11:
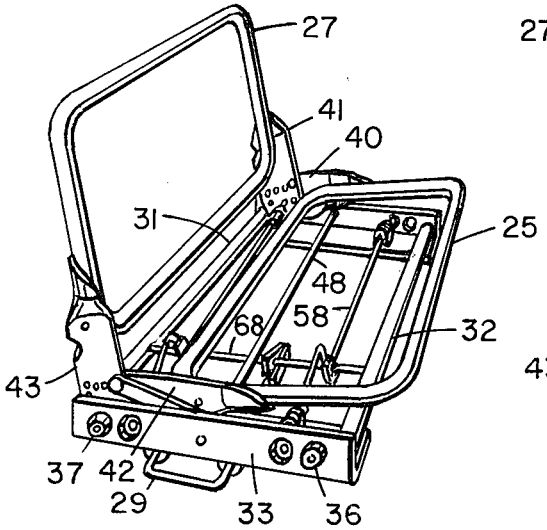
FIG. 11 illustrates a possible placement of the seat and back sections in an angular relationship giving an increased pitch to the seat.

The seat and back sections are the same, and are each provided with end plates as shown at 40–41 and 42–43. These plates are similar in configuration, and are in close overlapping relationship. The plates are pivotally interconnected by the same pin 44 that provides the pivotal connection of this sub-assembly with the link 45. The same arrangement appears on the opposite side of the structure at the pin 46 and the link 47, the two links 45 and 47 being solidly secured to the shaft 48 rotatably mounted in the angle members 33 and 34 of the frame. Each of the seat-back sections is capable of functioning as either a seat or a back, and the lateral shifting between the positions shown in FIGS. 5 and 7 places the sub-assembly in position to be engaged by a locking system that secures the angular relationship of the sections, and also secures the sub-assembly with respect to the base frame. Brackets as shown at 49–50 and 51–52 are mounted on the end members 33 and 34, as shown best in FIGS. 9 and 10. These brackets provide guideways for the sliding movement of the bolts 53–56. These bolts are positioned to traverse arcuately aligned holes in the overlapping end plates, and also traverse the holes as shown at 57 and 58 in FIG. 5 in each of the frame members 33 and 34. This arrangement makes the interengagement of the bolts capable of securing the angular position of the seat-back units, and also the position of this sub-assembly at either side of the shifting movement determined by the links 45 and 47.

Figure 8:
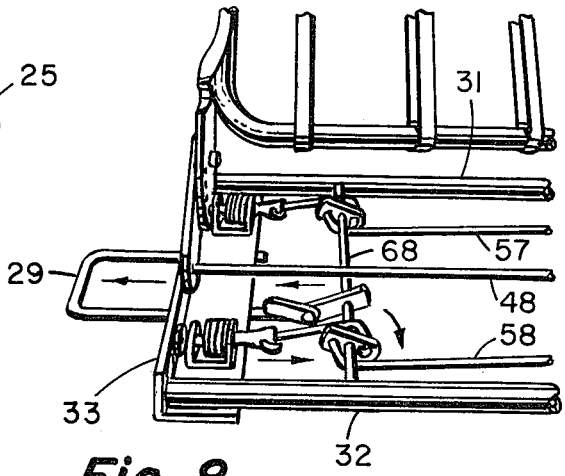
FIG. 8 is a fragmentary perspective view on an enlarged scale at one side of the unit, with the seat section removed, to show the locking system in the disengaged position.
Figure 6:
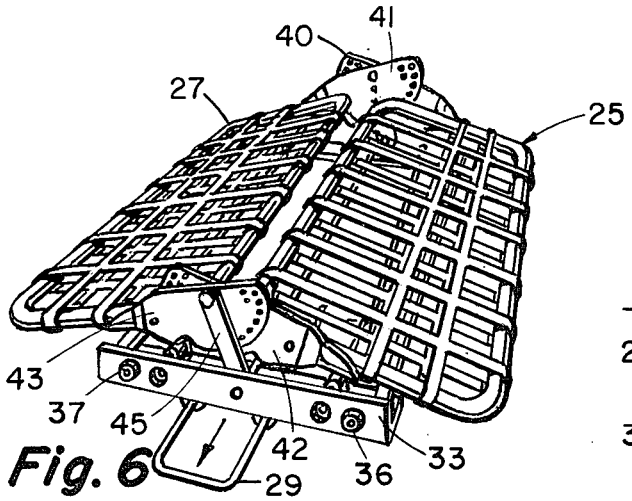
FIG. 6 is a view of a structure shown in FIG. 5 showing an intermediate position in the lateral shifting of the seat and back sections.

The bolts 53 and 54 are controlled by a combination of the effect of the pull rods 57 and 58 and the springs 59 and 60, the latter having the effect of biasing the bolts to the locking position. The bolts 55 and 56 are controlled by the combined effect of the short links 62 and 63 and the springs 64 and 65. An over-center toggle system incorporates the links 62–63 and the pull rods 57 and 58, and also includes the arms 66 and 67 mounted on the shaft 68 rotatably mounted at the opposite ends in the frame tubes 31 and 32. The rods 57 and 58 and the links 62 and 63 are pivotally connected to the arms 66 and 67, and a crank arm 69 produces torque for the rotation of the shaft 68 as a result of the pivotal connection at 70 with an extension of the handle 29, which is slideably mounted on the end member 33 of the frame in the guides 33 *a–b*. Pulling the handle from the FIG. 7 to the FIG. 6 position will slide the handle in its guides 33 *a–b*, and induce a clockwise rotation of the shaft 68, as viewed in FIG. 9, and will rotate the arms 66 and 67 approximately 90° to an over-center position against the action of the bolt springs. The mechanism is then unlocked, with the bolts no longer traversing either the end plates or frame, leaving the sub-assembly of the seat and back sections free for relative angular articulation, and for shifting between the FIG. 5 and FIG. 7 positions. During the sliding movement of the handle, the arcuate movement at the connection at the pivot 70 requires a looseness in the sliding fit of the handle 29 in the guides 33 *a–b*. The components interengage in this position to form a limit stop to the locking system, as shown in FIG. 8, where the offset ends of the rods 57 and 58 bear on the shaft 68.

Figure 7:
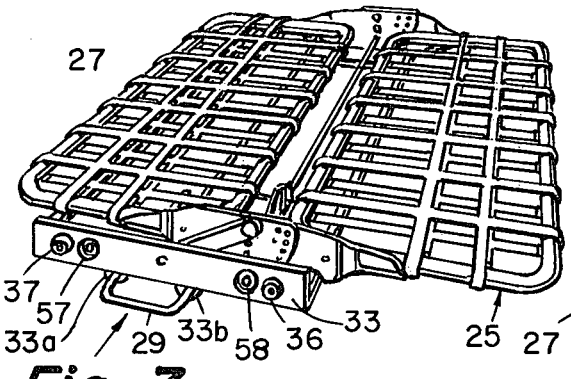
FIG. 7 is a view similar to FIG. 5, but with the lateral shift completed, and the locking system re-engaged.
Figure 12:
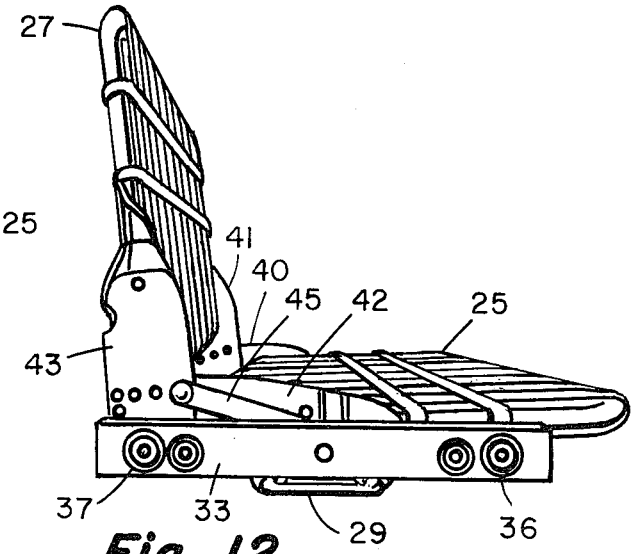
FIG. 12 is a perspective approaching side elevation of the seat unit in the condition in which the seat section is close to a horizontal position.
Figure 13:
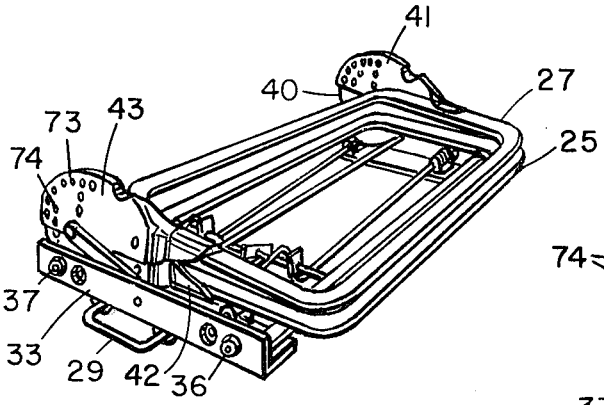
FIG. 13 illustrates a selected available position showing the seat and back sections brought into horizontal parallelism, which provides a convenient position for shipment of the entire integral assembly.
Figure 14:
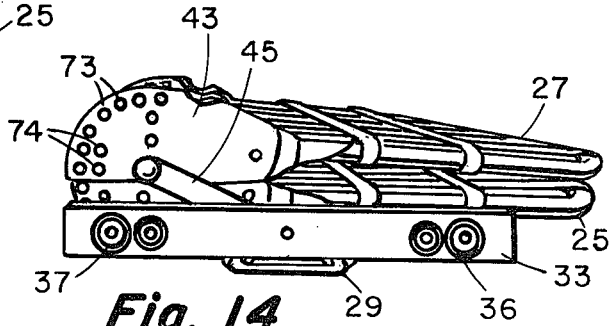
FIG. 14 is a perspective view close to side elevation of the FIG. 12 structure in the FIG. 13 position.
Figure 15:
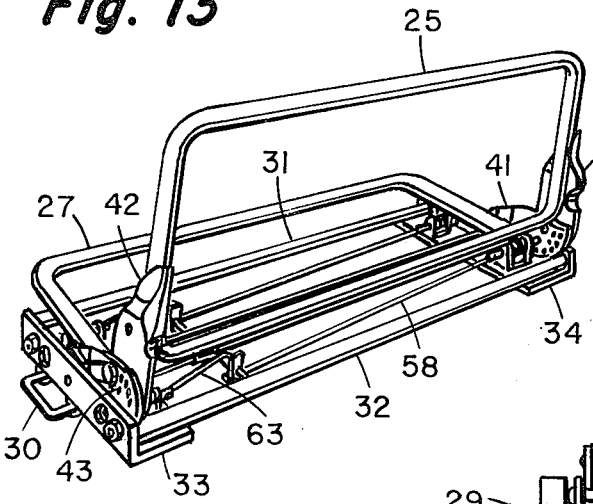
FIG. 15 is a perspective view of the assembly shifted from the FIG. 11 position to the opposite position, with the webbing removed.
Figure 16:
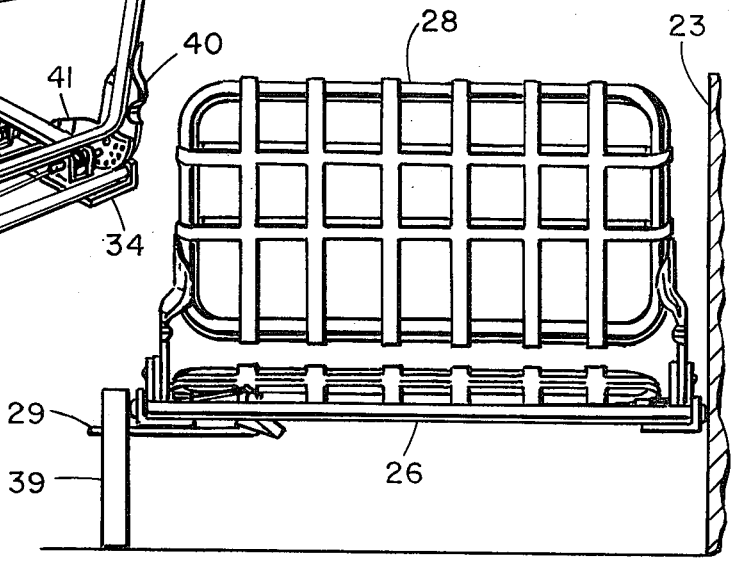
FIG. 16 is a view similar to FIG. 15, with the webbing shown in position, and the unit installed.

Referring particularly to FIG. 7, a close structural analysis of the locked relationship of the components establishes that the section 25 is supported in its cantilever extension by an interesting arrangement of forces. First, it is pivotally secured with respect to the frame by the engagement of the bolt 56 with the side plates and the hole 58. It is rotatively fixed about this point of pivotal connection by the presence of the link 45 pivotally connected to the frame at the shaft 48. The distance between the points 58 and the points 49 (at all four positions around the structure) is comparatively short, however, and the placement of a substantial load at the right-hand extremity of the section 25, as viewed in FIG. 7, would place a considerable strain on the structure in generating the necessary reaction moment. To reduce the resulting deflection characteristics, all of the end plates are provided with formed flanges as shown at 71 in FIG. 10, having the arcuate portions 72 capable of engaging either the frame tube 31 or 32. The offsets at 72 engage the frame tubes only in the FIG. 5 or FIG. 7 positions, at which time the sub-assembly of the seat-back sections is slightly higher with respect to the frame than it is in the seat position illustrated in FIG. 12. This difference in elevation makes necessary the provision of the two sets of arcuately aligned holes as shown at 73 and 74 in each of the end plates, so that the locking bolts can traverse these plates in either of the two positions. The engagement of the offsets 72 with the frame tubes provides additional support adding rigidity to the structure. Such support is commonly referred to as "redundant".

I claim:

1. A convertible seat-bed unit including a base frame and seat and back sections moveably mounted on said frame for horizontal shifting and for angular shifting of said back section between erect and horizontal positions, wherein the improvement comprises:

side plates mounted at the opposite sides of said sections and disposed with side plates of said seat section closely overlapping the side plates of said back section on each side of said seat unit;

pivot means interconnecting said side plates on each side of said unit;

a link on each side of said unit pivotally connected at one end to said frame, and at the opposite end to one of said overlapped side plates; and locking means moveably mounted in said base frame, and including members adapted to interengage with said side plates at positions spaced from the axis of pivotal interconnection thereof, and from the axis of pivotal connection of said link means to said one side plate, to secure the angular relationship of said seat and back sections, and secure said sections with respect to said frame, said locking means including a guideway bracket mounted on said frame, and an elongated bolt axially slideably mounted in said bracket.

2. A seat-bed unit as defined in claim 1, wherein said locking means is disposed at a plurality of positions on said frame to engage said side plates in selected positions of said link means with respect to said frame.

3. A seat-bed unit as defined in claim 1, wherein said link means at the opposite sides of said seat unit are secured to a common shaft rotatably mounted in said frame.

* * * * *